US006403275B1

(12) United States Patent
Kuramoto et al.

(10) Patent No.: US 6,403,275 B1
(45) Date of Patent: Jun. 11, 2002

(54) ELECTROPHOTOGRAPHIC TONER, AND IMAGE FORMING METHOD AND APPARATUS USING THE TONER

(75) Inventors: Shinichi Kuramoto; Mitsuo Aoki; Hiroshi Yamashita; Fumihiro Sasaki; Tomio Kondou; Masahide Yamashita; Kazuhito Watanabe, all of Shizuoka-ken; Takashi Okada, Kanagawa-ken, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/653,452

(22) Filed: Aug. 31, 2000

(30) Foreign Application Priority Data

Aug. 31, 1999 (JP) ..... 11-244689
Oct. 25, 1999 (JP) ..... 11-302169

(51) Int. Cl.[7] ..... G03G 9/087
(52) U.S. Cl. ..... 430/111.4; 399/298; 430/47
(58) Field of Search ..... 430/47, 106, 109, 430/110, 111.4, 124; 399/298

(56) References Cited

U.S. PATENT DOCUMENTS

| | | | | |
|---|---|---|---|---|
| 4,933,250 | A | 6/1990 | Nakayama et al. | 430/106 |
| 4,956,258 | A | 9/1990 | Watanabe et al. | 430/109 |
| 4,980,258 | A | 12/1990 | Aoki et al. | 430/110 |
| 5,061,588 | A | 10/1991 | Fushimi et al. | 430/109 |
| 5,368,972 | A | 11/1994 | Yamashita et al. | 430/137 |
| 5,370,959 | A | 12/1994 | Hagiwara et al. | 430/120 |
| 5,380,616 | A | 1/1995 | Aoki et al. | 430/110 |
| 5,403,690 | A | 4/1995 | Kuramoto et al. | 430/110 |
| 5,554,478 | A | 9/1996 | Kuramoto et al. | 430/110 |
| 5,565,298 | A | 10/1996 | Suguro et al. | 430/137 |
| 5,750,299 | A | 5/1998 | Ohshima et al. | 430/47 |
| 5,851,716 | A | 12/1998 | Kuramoto et al. | 430/110 |
| 5,882,832 | A | 3/1999 | Tosaka et al. | 430/106 |
| 5,994,016 | A | 11/1999 | Kuramoto et al. | 430/110 |
| 5,998,073 | A | 12/1999 | Kuramoto et al. | 430/106 |
| 6,120,960 | A * | 9/2000 | Aoki et al. | 430/109 |
| 6,200,719 | B1 * | 5/2001 | Kuroda | 430/110 |

FOREIGN PATENT DOCUMENTS

| | | |
|---|---|---|
| JP | 02-160250 | 6/1990 |
| JP | 02-161462 | 6/1990 |
| JP | 07-210019 | 8/1995 |
| JP | 08095287 | 4/1996 |

* cited by examiner

*Primary Examiner*—John Goodrow
(74) *Attorney, Agent, or Firm*—Oblon, Spivak, McClelland, Maier & Neustadt, P.C.

(57) ABSTRACT

A toner including a resin and a colorant which is dispersed in the toner and which has an average major particle diameter not greater than about 0.5 $\mu$m, wherein the following relationships are satisfied: Ta≦100 (° C.), and (Tb−Ta) ≧7.0 (° C.), wherein Ta represents a temperature at which the toner has a melt viscosity of 50,000 Pa·sec and Tb represents a temperature at which the toner has a melt viscosity of 5,000 Pa·sec.

19 Claims, 4 Drawing Sheets

ELECTROPHOTOGRAPHIC TONER, AND IMAGE FORMING METHOD AND APPARATUS USING THE TONER

BACKGROUND OF THE INVENTION

1. Field of the Invention

The present invention relates to a toner for developing an electrostatic latent image, and image forming method and apparatus using the toner. More particularly, the present invention relates to a toner for use in an image forming method in which a toner image formed on a receiving material is fixed upon application of heat while the toner image is contacting a belt.

2. Discussion of the Background

Currently, image fixing devices using a heat roller are widely used for electrophotographic image forming apparatus such as copiers and printers because the fixing devices have a simple structure and are easy to handle.

However, the image fixing methods using a heat roller have a drawback such that it takes a long time to rise the temperature of the heat roller to a predetermined fixing temperature. In attempting to remedy this drawback, Japanese Laid-Open Patent Publications Nos. 2-160250 and 2-161462 have disclosed image fixing techniques using a combination of a belt fixing device and a toner therefor In particular, it is desired for electrophotographic color copiers and printers to produce glossy color toner images. Therefore, it is needed to lengthen the fixing time during which a toner image contacts a heat element such as a heat roller (this fixing time is sometimes referred to as a nipping time). In order to lengthen the nipping time, a heat roller having an elastic material thereon is typically used. Elastic materials are generally a heat insulator. Therefore, in color copiers and printers using a heat roller having an elastic material thereon, the waiting time becomes much longer than that in monochrome (black and white) copiers and printers because the elastic material has to be also heated so as to be the predetermined temperature. In image fixing devices using a belt-shaped fixing element (hereinafter referred to as a belt fixing method), a desirable nipping time can be obtained by using a heat insulation belt (i.e., without using an elastic material).

In addition, in color copiers and printers using a heat roller for fixing toner images, it is needed to apply a silicone oil to a pair of fixing rollers (i.e., the heat roller and a pressure roller) in an amount of few milligrams per one copy to securely release toner images from the pair of fixing rollers. When a large amount of a silicone oil is applied thereto, a problem which occurs is that the silicone oil is transferred onto a receiving material. When a transparent sheet for use in overhead projection (OHP) is used as a receiving material, the silicone oil adheres to the transparent sheet, resulting in deterioration of the image qualities of projected color images, such as transparency. In addition, it is unpleasant to touch such oily copy sheets.

In attempting to solve the problems, Japanese Laid-Open Patent Publications Nos. 7-210019 and 8-95287 have disclosed a belt fixing method in which no oil is used (i.e., an oil-less fixing method) or a small amount of an oil is used.

As mentioned above, the belt fixing method has the following advantages:

(1) the wait time is very short;

(2) a small-sized fixing units can be used; and (3) it is possible to apply no oil or only a small amount of an oil to the belt. However, the belt fixing methods have the following drawbacks:

(1) the life of a belt is short;

(2) image qualities deteriorate when a belt is hurt; In particular, when a color image is fixed using a hurt belt, the resultant fixed color image has an image defect corresponding to the hurt of the belt, such as nonglossy images.

In attempting to prolong the life of a belt, Japanese Laid-Open Patent Publications Nos. 4-328531 and 8-95287 respectively disclose a toner having a specific Wadell sphericity, and a toner including a specific resin which is useful when the toner is manufactured using a pigment master batch. However, their effects are not satisfactory.

Although belt fixing methods have an advantage to shorten the waiting time, the belt fixing methods have a disadvantage such that a plenty of cool receiving materials successively pass through the belt fixing device, the temperature of the belt fixing device varies because the belt fixing device has no heat storage elements. Therefore, problems such that poorly-fixed toner images are produced and/or an offset image problem in which an image is offset to another image tend to occur unless the toner used has a wide fixable temperature range.

Because of these reasons, a need exists for a toner which has a wide fixable temperature range (i.e., which can produce good fixed images even when used for a belt fixing method) and which hardly damage the belt-shaped fixing element.

SUMMARY OF THE INVENTION

Accordingly, an object of the present invention is to provide a toner which can produce good fixed images even when used for a toner image fixing method using a belt-shaped fixing element and which hardly damage the belt-shaped fixing element.

Another object of the present invention is to provide a two-component developer which can produce good fixed images even when used for a toner image fixing method using a belt-shaped fixing element and which hardly damage the belt-shaped fixing element.

Yet another object of the present invention is to provide image forming method and apparatus in which the waiting time is short and which can produce good images without image defects for a long time.

A further object of the present invention is to provide a method for manufacturing the toner mentioned above.

Briefly these objects and other objects of the present invention as hereinafter will become more readily apparent can be attained by a toner including a colorant which is dispersed in the toner and which has an average major particle diameter not greater than 0.5 $\mu$m, wherein the toner has the following property:

$$Ta \leqq 100\ (^\circ\ C.),\ \text{and}\ (Tb-Ta) \geqq 7.0\ (^\circ\ C.)$$

wherein Ta represents a temperature at which the toner has a melt viscosity of 50,000 Pa·sec and Tb represents a temperature at which the toner has a melt viscosity of 5,000 Pa·sec.

Preferably, the toner is provided using a process of preparing a pigment master batch in which toner constituents including at least a colorant and a resin are kneaded while being heated at a temperature ranging from a glass transition temperature of the resin to a temperature higher than the glass transition temperature by 40° C.

In another aspect of the present invention, an image forming method is provided which includes the steps of:

providing the toner mentioned above;

developing an electrostatic latent image with the toner to prepare a toner image;

transferring the toner image on a receiving material; and bringing the toner image on the receiving material into contact with a belt or an endless belt of a belt fixing device to fix the toner image.

It is possible to prepare a color image by performing the developing steps in plural times using plural color toners, for example, a cyan, magenta and yellow color toner.

In further aspects of the present invention, a toner container including the toner mentioned above and an image forming apparatus having the toner container are provided.

In a still further aspect of the present invention, a two-component developer is provided which includes a carrier and the toner mentioned above. The carrier is preferably one from which carrier particles having a relatively low magnetic force are previously removed.

In still further aspects of the present invention, a developer container including the developer mentioned above and an image forming apparatus having the developer container are also provided.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
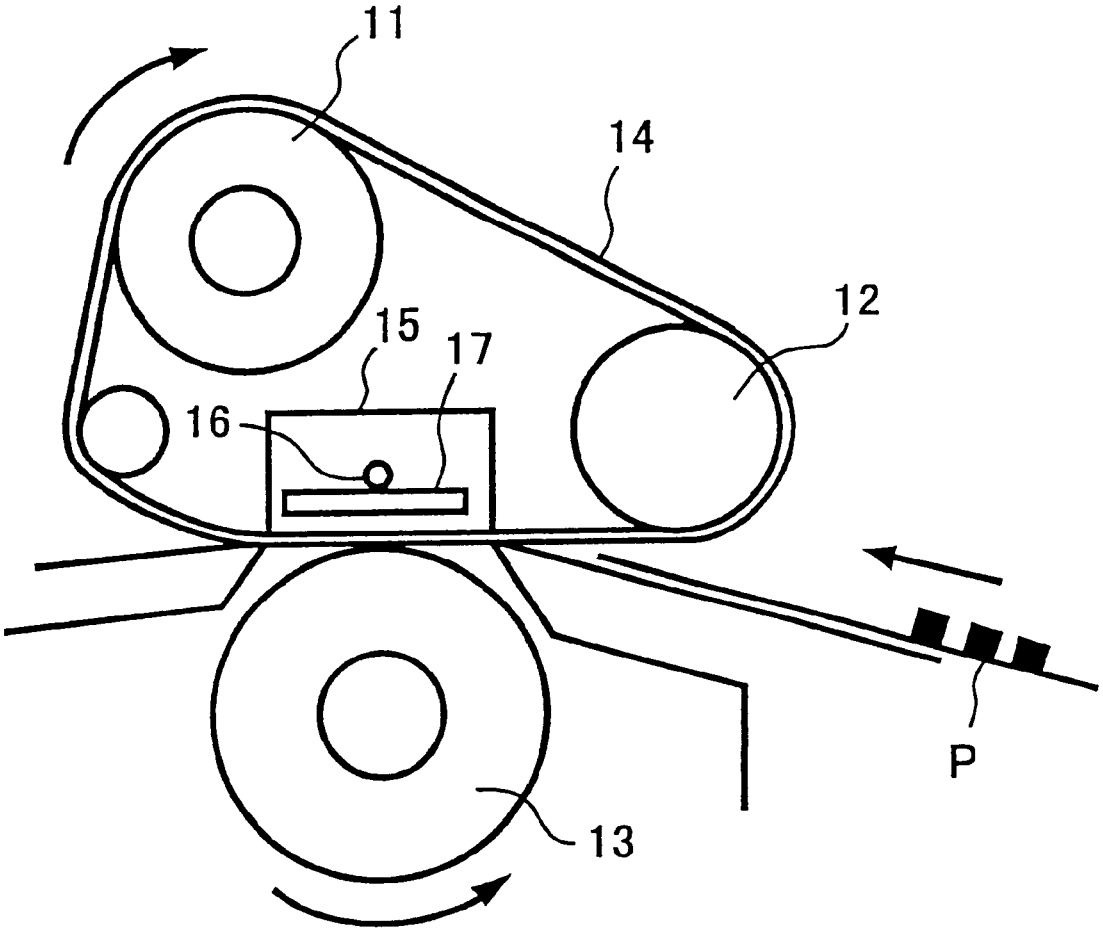
FIG. 1 is a schematic view illustrating a fixing device having a belt-shaped fixing element for use in the image forming method and apparatus of the present invention.

Generally, the present invention provides a toner which is useful for an image forming method including a step of fixing a toner image formed on a receiving material while bringing the toner image into contact with a belt-shaped fixing element of a belt fixing device. The toner hardly damages the belt-shaped fixing element. Therefore, good images without image defects caused by hurts of the belt-shaped fixing element can be produced even when images are repeatedly produced for a ling time. In particular, the toner is useful for a color image forming method in which a color image constituted of a plurality of color toner images, which has been formed on a receiving material, is fixed using a belt-shaped fixing element. In such a color image forming method, when the belt-shaped fixing element has a hurt on the surface thereof with which a toner image to be fixed is to be contacted, the resultant fixed toner image has a mat area although the other image area is glossy. This mat area corresponds to the hurt area of the belt-shaped fixing element. Namely, the mat area is formed while not contacting the belt or not being pressed by the belt because the hurt area is recessed. Therefore, when a belt-shaped fixing element is hurt, the fixing element must be changed to new one, resulting in increase of running costs of the image forming apparatus.

The present inventors examine the reason of a hurt of a belt-shaped fixing device. As a result, it is found that the hurt is mainly caused by the pigments included in a toner image (i.e., the pigments (colorant) included in the toner used). Toner particles adhered on the belt-shaped fixing element are cleaned with a cleaning element. When the toner particles accumulate on the cleaning element and there is a large pigment particle therein whose particle diameter is greater than a specific particle diameter, the large pigment particle hurts the belt. In addition, it is also found that the number of the hurts formed on the belt fixing element is dramatically decreased when a pigment dispersed in the toner used has an average major particle diameter not greater than about 0.5 $\mu$m, and preferably not greater than 0.4 $\mu$m, although the upper limit of the major particle diameter depends to some extent on the material of the pigment. The lower limit of the average major particle diameter is about 0.1 $\mu$m.

In order to prepare a toner in which a pigment (colorant) is dispersed therein in a major particle diameter not greater than about 0.5 $\mu$m, it is needed to perform a so-called master batch process in which a pigment is preliminarily kneaded together with a resin and/or the like to be included in the toner at a relatively high pigment concentration to prepare a master batch of the pigment. The pigment master batch is then kneaded together with the remaining resin and other toner constituents such as a charge controlling agent while being heated. The kneaded mixture is then cooled, and pulverized and classified to prepare a mother toner. The mother toner is typically mixed with a fluidity imparting agent. Thus a toner is prepared.

In the present invention, when a pigment master batch is prepared, various methods can be used. For example, flushing methods which use a wet pigment cake, and methods in which a dry pigment powder is kneaded with a resin using a kneader such as two-roll mills, three-roll mills and two-axis extruders, can be used for preparing a pigment master batch. In order to prepare a pigment master batch for use in the present invention, in which a pigment having the specific major particle diameter is dispersed, it is preferable that one of the methods is repeatedly performed plural times, or two or more of the methods mentioned above are combined. In addition, it is also preferable that a dispersant is used when preparing the pigment master batch. In particular, a method in which a high kneading energy can be applied to the pigment when the pigment is kneaded together with a resin is preferably used in the present invention.

In order to apply a high kneading energy to the pigment in a master batch preparation process, it is preferable that the pigment and the resin is kneaded at a temperature ranging from a glass transition temperature (Tg) of the resin to a temperature higher than the glass transition temperature by 40° C. (i.e., from the Tg to a temperature of (Tg+40° C.)). It is more preferable that the upper limit of the temperature range is not greater than a temperature of (Tg+20° C.). When the temperature is less than the glass transition temperature (Tg) of a resin, the mixture cannot be kneaded because the kneader is locked. On the contrary, when the temperature is higher than the temperature of (Tg+40° C.), the viscosity of the mixture extremely decreases, and thereby the pigment cannot be efficiently kneaded. Therefore, aggregates tend to remain in the resultant kneaded mixture. When the pigment is kneaded at a temperature in the above-mentioned temperature range, the energy applied to the mixture to be kneaded is efficiently used for grinding the pigment included in the mixture. From the viewpoint of shear strength applied to the mixture, two-roll mills are preferably used. Thus, the pigment can be dispersed so as to have a major particle diameter not greater than about 0.5 $\mu$m.

The particle diameter of a pigment dispersed in a toner can be measured by a method utilizing scattering of laser light or the like method. In the present invention, the particle diameter is measured as follows:

(1) a thin film of a kneaded toner mixture, which is not yet pulverized, is prepared using a microtome; and (2) the thin film is observed with a transmission electron microscope (TEM) to determine the maximum major diameter of particles present in a squaric area each of whose sides has a length of 0.1 mm.

Needless to say, the thin film of the toner mixture can be prepared by embedding a pulverized toner mixture in a resin and then cutting the mixture using a microtome.

In the present invention, the particle diameter of a pigment dispersed in a toner is represented as the major particle diameter.

The major particle diameter of a pigment particle is defined as the length of a circumscribed rectangle of the cross section of the pigment particle observed by a TEM. An average major particle diameter of a pigment in a toner is determined by measuring the major particle diameter with respect to 50 particles of the pigment and then averaging the major particle diameters.

As mentioned above, although the belt fixing method has an advantage to shorten the waiting time, the fixing method has a disadvantage such that when a plenty of cool receiving materials successively pass through the fixing device, the temperature of the fixing device varies because the fixing device has no heat storage elements.

Therefore, the toner for use in the belt fixing method preferably has a wide fixable temperature range in which the toner can be securely fixed without producing any image defects such as a poorly-fixed image and an offset image. The toner of the present invention have to have the following property:

$$Ta \leqq 100\ (^\circ\ C.),\ \text{and}\ (Tb-Ta) \geqq 7.0\ (^\circ\ C.)$$

wherein Ta represents a temperature at which the toner has a melt viscosity of 50,000 Pa·sec, and Tb represents a temperature at which the toner has a melt viscosity of 5,000 Pa·sec.

Ta is not higher than 100° C., and preferably not higher than 90° C. In addition, Ta is preferably not lower than about 80° C.

In the present invention, the melt viscosity of a toner is measured using a flow tester, CFT-500 manufactured by Shimazu Corp. (a Japanese company), under the following conditions:

Diameter of die: 1 mm

Length of die: 1 mm

Pressure of cylinder: 10 kg/cm$^2$

Temperature rising speed: 2.0° C./min

Figure 2:
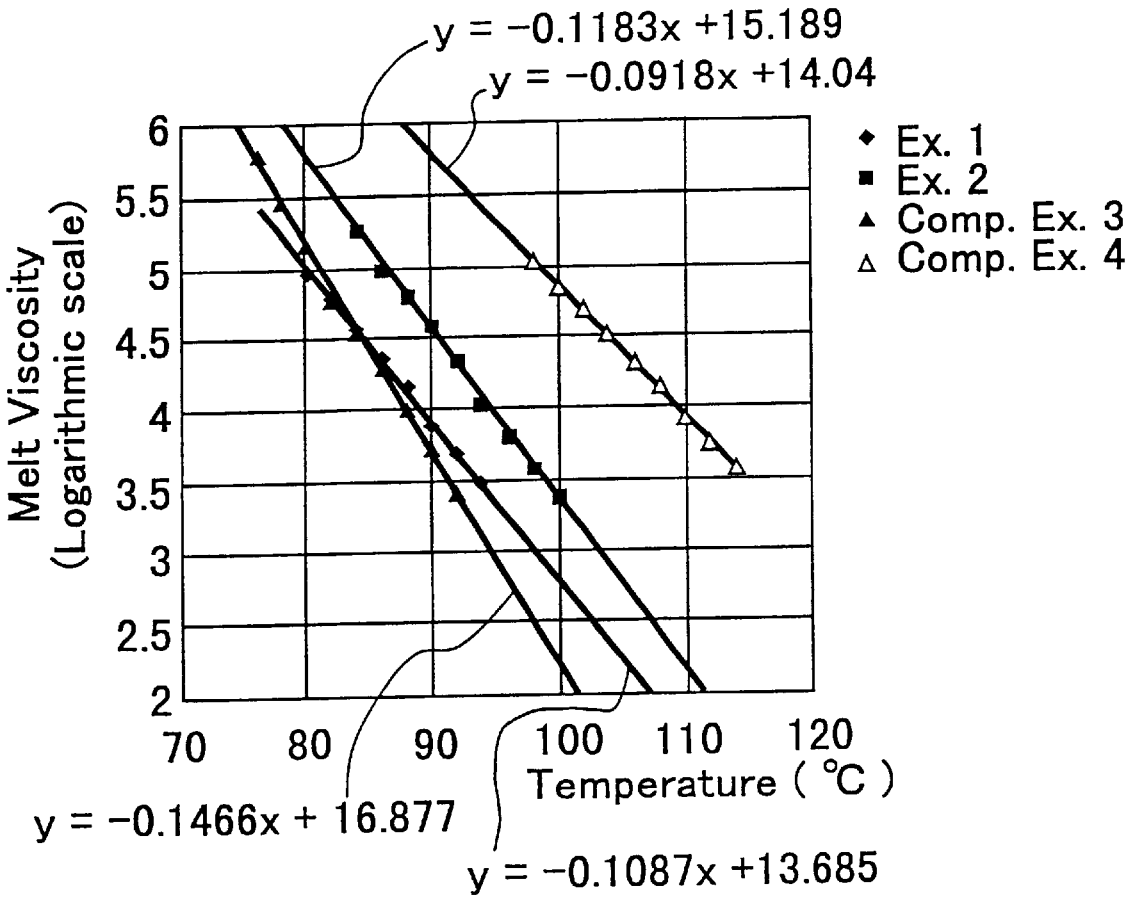
FIG. 2 is a graph illustrating melt viscosity changes of the toners prepared in Examples 1 and 2 and Comparative Examples 3 and 4.

The temperatures Ta and Tb are determined by preparing a line illustrating the relationship between a temperature and a melt viscosity of a toner as shown in FIG. 2.

The melt viscosity of a toner mainly depends on a resin included in the toner, and the concentration and the particle diameter (major particle diameter) of the pigment dispersed in the toner. When the concentration of a pigment included in a toner is high, the toner has a high melt viscosity. When the particle diameter of a pigment included in a toner is small, the melt viscosity of the toner tends to decrease.

In order to prepare the toner of the present invention having the melt property mentioned above, the following procedures are preferable:

(1) an addition quantity of a colorant to be included in a toner is determined depending on the desired coloring strength of the toner; and (2) dispersing conditions are properly set based on the addition quantity of the colorant and the melt viscosity of a resin to be included in the toner.

In this case, it is preferable that a resin having a relatively high melt viscosity is used for the toner and the toner constituents are dispersed under hard conditions such that the kneaded toner constituents have the melt property mentioned above.

As the toner constituents, known toner constituents can be used in the present invention.

The toner of the present invention includes at least a colorant and a resin.

Suitable binder resins for use in the toner of the present invention include styrene polymers and substituted styrene polymers such as polystyrene, poly-p-chlorostyrene, polyvinyltoluene and the like; styrene copolymers such as styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl $\alpha$-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers and the like; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, and the like. These resins are used alone or in combination.

Suitable colorants include known dyes and pigments. Specific examples of the colorants include carbon black, Nigrosine dyes, iron black, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The concentration of the colorant in the toner is preferably from 0.1 to 50 parts by weight, and more preferably from 1 to 10 parts by weight, per 100 parts by weight of the binder resin included in the toner.

The toner of the present invention may include a charge controlling agent. As the charge controlling agent, known charge controlling agents can be used. Specific examples of the charge controlling agent include Nigrosine dyes, triphenylmethane dyes, chromium-containing metal complex dyes, chelate pigments of molybdic acid, Rhodamine dyes, alkoxy amines, quarternary ammonium salts (including quarternary ammonium salts modified by fluorine), alkylamides, phosphorous, phosphorous compounds, tungsten, tungsten compounds, fluorine-containing surfactants, salicylic acid metal salts, metal salts of salicylic acid derivatives, and the like compounds. These compounds can be used alone or in combination.

The concentration of the charge controlling agent in the toner of the present invention depends on the species of the binder resin used, whether other additives are present, and the method for manufacturing the toner. In general, the concentration is from 0.1 to 10 parts by weight, and preferably from 2 to 5 parts by weight, per 100 parts by weight of the binder resin included in the toner. When the concentration of the charge controlling agent is too low, the charge of the resultant toner is insufficient and therefore the toner cannot be practically used. On the contrary, when the concentration is too high, the resultant toner has a high charge and therefore the electrostatic attraction between the toner and a carrier increases, resulting in deterioration of fluidity of the developer and decrease of the image density of the resultant images.

The toner may include other additives such as colloidal silica, hydrophobic silica, fatty acid metal salts (e.g., zinc stearate and aluminum stearate), metal oxides (e.g., titanium oxide, aluminum oxide, tin oxide and antimony oxide), fluoro polymers, and the like compounds.

The toner of the present invention can be used as a one component developer which is constituted of only a toner and which is used for developing an electrostatic latent image. In addition, the toner of the present invention can be used for a two component developer which is a mixture of a toner and a carrier. In this case, only the toner is attracted to an electrostatic latent image, resulting in formation of a toner image.

Suitable carrier materials for use in the two component developer include iron powders, ferrite, glass beads, and the like materials. The surface of these materials may be coated with a resin such as polyfluorocarbons, polyvinyl chloride, phenolic resins, polyvinyl acetal, silicone resins, and the like. The mixing ratio of the toner to the carrier in a two component developer is preferably 0.5/100 to 6.0/100 by weight.

When carrier particles having a low magnetic force such that the attraction between the carrier particles and developing sleeve having a magnet therein is less than the attraction between the carrier and an electrostatic latent image to be developed and formed on a photoreceptor, to which a developing bias voltage is applied, are present in a two component developer, the carrier particles tend to be attracted to the photoreceptor, resulting in formation of a toner image including the carrier particles on the photoreceptor. The toner image including the carrier particles are transferred onto a receiving material, and when the toner image is fixed in a fixing device having a belt-shaped fixing element, the carrier particles hurt the belt fixing element. Therefore, in the present invention it is preferable to previously remove such carrier particles having a low magnetic force from a carrier material using a screening machine utilizing magnetic force.

The fixing device of the present invention will be explained referring to FIG. 1. In FIG. 1, a receiving material P having a toner image thereon, which is fed in a direction as indicated by an arrow, enters a nip between a belt 14 (i.e., a film) and a pressure roller 13 to fix the toner image. The belt 14 is rotated in a direction as indicated by an arrow by a drive roller 11 while being supported by driven rollers 11 and 12 and the drive roller 11. The pressure roller 13 also rotates in a direction as indicated by an arrow. A heating element 15, which is fixed (not moved) and which faces the pressure roller 13 contacts the belt 14 while being pressed by the pressure roller 13.

The heating element 15 has linear heating elements 17 having a low heat capacity. The linear heating elements 17 are made by coating a resistance material having a width of from 1 to 2 mm. A voltage is applied to both ends of the linear heating elements 17 so that the resistance material generates heat. The belt 14 is fed in a direction as indicated by an arrow while contacting the heated heat element 15. Therefore the toner image T on the receiving material P, which is fed by the belt 14, is heated by the heat element 15, and thereby the toner image is fixed on the receiving material P. Numeral 16 denotes a temperature sensor which detects the temperature of the linear heating elements 17. The receiving material P having a fixed toner image thereon is then discharged from the fixing device.

Suitable materials for use as the belt 14 include heat-resistant films having a thickness of from about 10 to about 35 $\mu$m. Specific examples of such films include polyester films, polyfluoroethylene-polyfluoropropylene copolymers (PFA), polyimides, polyether imides, and the like. On the film, a release layer constituted of a release material such as polytetrafluoroethylene (PTFE) or PFA, which includes an electroconductive material and which has a thickness of from about 5 to 15 $\mu$m is preferably formed. Therefore the total thickness of the belt 14 is from about 10 to about 100 $\mu$m.

The drive roller 11 and the driven rollers 12 and 18 rotate the belt 14 in the direction as indicated an arrow while applying a tension to the belt 14 so that the belt 14 is rotated without wrinkling and zigzagging. On the surface of the pressure roller 13, an elastic layer is formed which is made of a material having good releasability, such as silicone rubbers. The pressure roller 13 presses the belt 14 to the heat element 15 upon application of pressure of from 2 to 30 kg while rotating in a direction as indicated by an arrow.

In FIG. 1, the belt 14 is endless, but is not limited thereto. For example, the belt 14 may be a sheet, one end of which is wound at a drive roller and the other end of which is wound at a driven roller.

Figure 3:
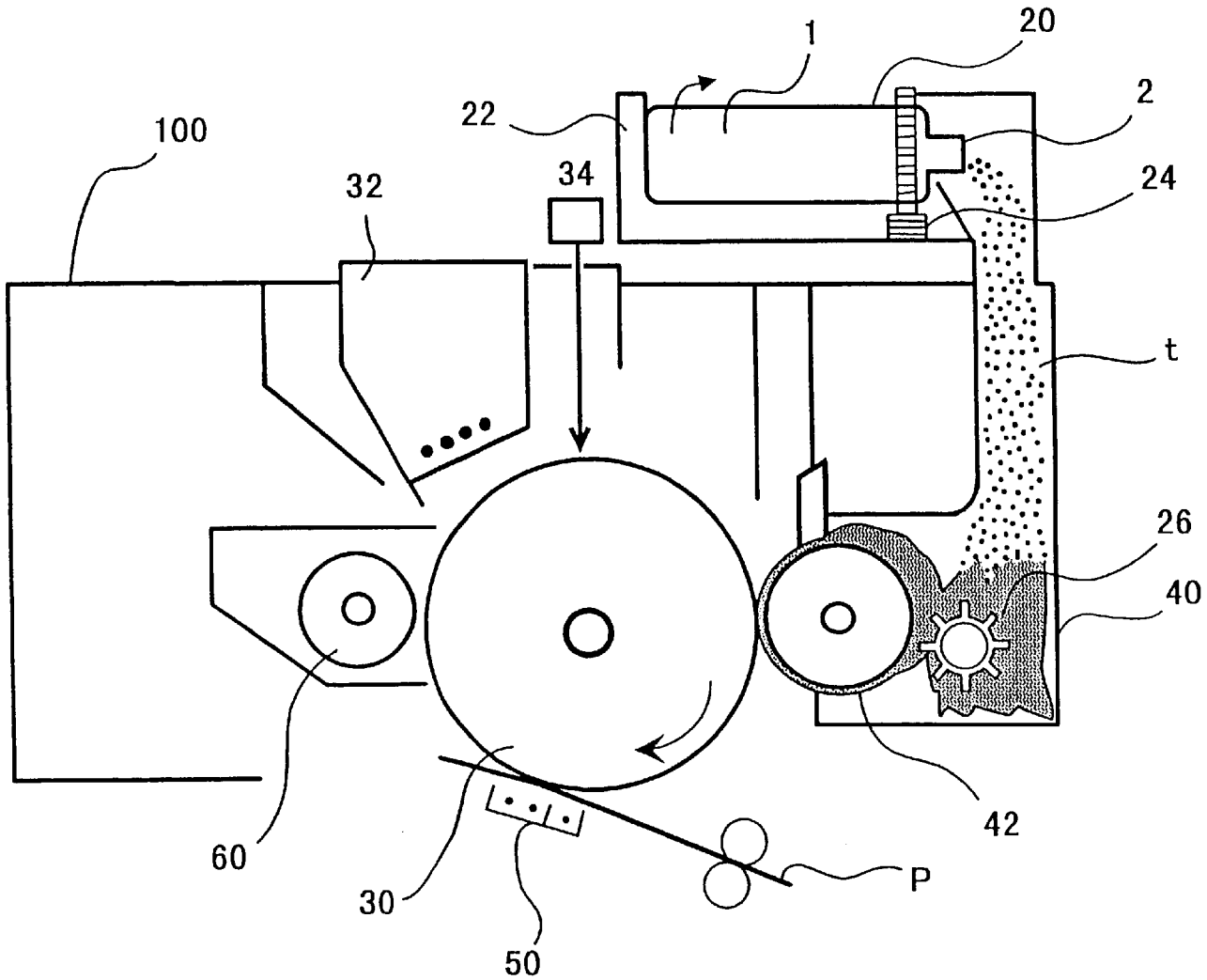
FIG. 3 is a schematic view illustrating a main part of an embodiment of the image forming apparatus of the present invention.

FIG. 3 is a schematic view illustrating a main part of an embodiment of the image forming apparatus 100 useful for the image forming method of the present invention.

As shown in FIG. 3, a toner container 1 is horizontally and detachably set in a toner supplying device 20 of an image forming apparatus 100. The toner supplying device 20 includes a toner container supporting member 22 which supports a toner container 1 such that the opening 2 of the toner container 1 leads to a toner supplying portion 26 in a developing device 40 of the image forming apparatus 100. In addition, the toner supplying device 20 includes a toner container rotating member 24 which rotates the toner container 1 such that the container 1 rotates around the center axis thereof. A toner t is discharged from the opening 2 toward the toner supplying portion 26.

As shown in FIG. 3, a layer of a developer including the toner t is formed on a developing roller 42. On the other hand, a photoreceptor 30 (i.e., an image bearing member) is charged with a charger 32. Then an imagewise light irradiating device 34 irradiates the charged photoreceptor with light to form an electrostatic latent image on the photoreceptor 30. The latent image is developed with the developer layer to form a toner image on the photoreceptor 30. The toner image is transferred to a receiving paper P using a transfer device 50. Then the photoreceptor 30 is cleaned with a cleaner 60. The toner image on the receiving paper P is fixed by a belt fixing device (not shown). Thus, a document is produced.

As mentioned above, the developer may be a one component developer (i.e., a toner) or a two component developer which includes a toner and a carrier. In a developing method using a two component developer, the container 1 may includes only a toner or a two component developer.

Hereinbefore, the present invention is explained using only one toner (developer). However, a plurality of toners (developers) can be used to form color images.

Figure 4:
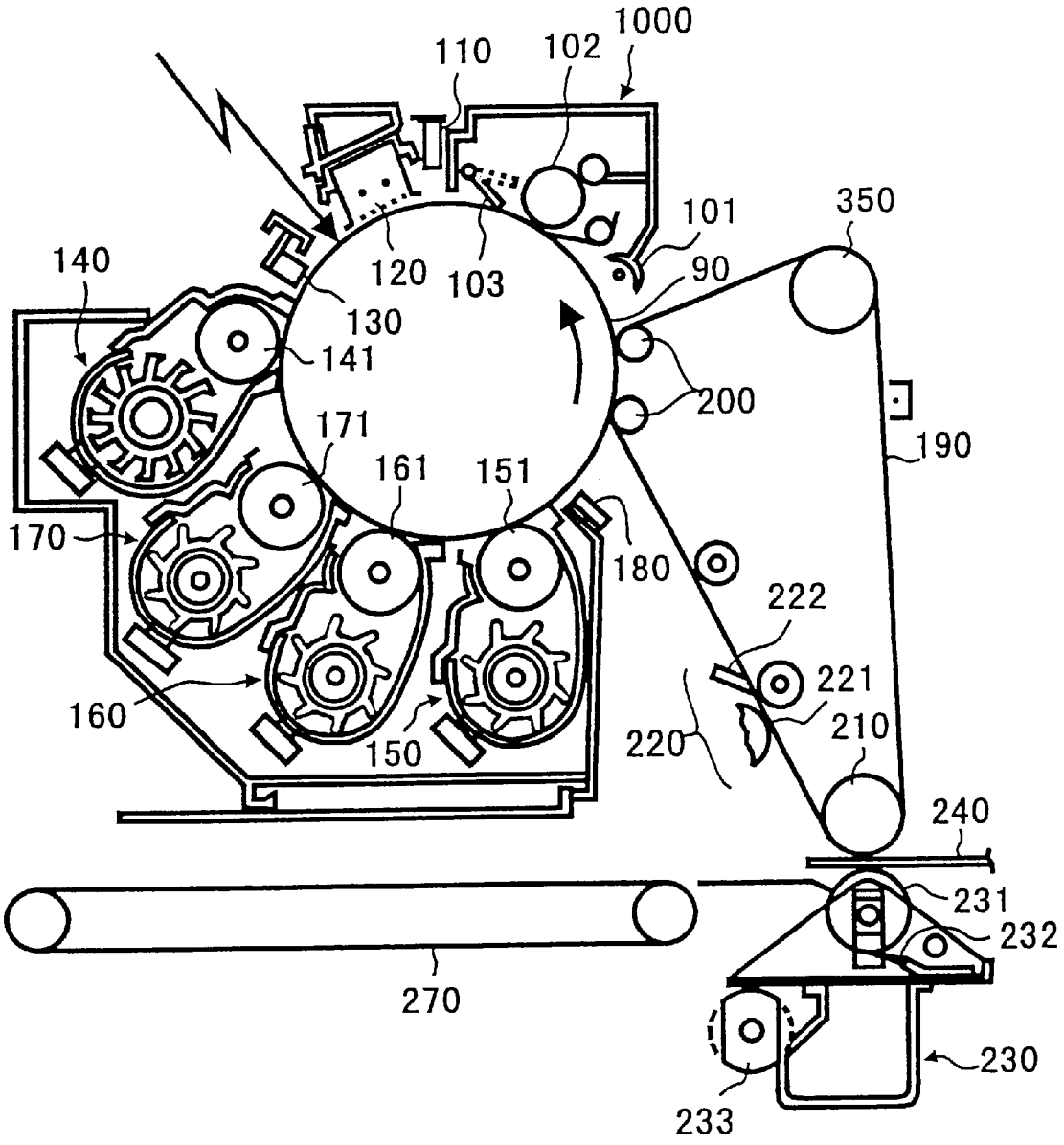
FIG. 4 is a schematic view illustrating a main part of another embodiment of the image forming apparatus of the present invention.

FIG. 4 is a schematic view illustrating a main part of the color image forming apparatus of the present invention.

In FIG. 4, a photoreceptor 90 rotates in the counterclockwise direction indicated by an arrow. Around the photoreceptor 90, a cleaning unit 1000 including a pre-cleaning discharger 101, cleaning roller 102 and a cleaning blade 103, a discharging lamp 110, a charger 120, a potential sensor 130, a Bk developing device 140 which develops an electrostatic latent image to form a black image, a C developing device 150 which develops an electrostatic latent image to form a cyan image, an M developing device 160 which develops an electrostatic latent image to form a magenta image, a Y developing device 170 which develops an electrostatic latent image to form a yellow image, a developing density detector 180, and an intermediate transfer belt 190 are provided. In each of the developing devices 140, 150, 160 and 170, a developing sleeve 141, 151, 161 or 171 is provided. The developing sleeve 141 (or 151, 161 or 171) rotates to feed a Bk (or C, M or Y) developer contained in the Bk (or C, M or Y) developing device 140 (or 150, 160 or 170) so as to face the photoreceptor 90. In addition, a developing paddle which rotates for agitating the toner, a toner concentration detector etc. are included in each of the developing devices 140, 150, 160 and 170. Hereinafter, the image forming method will be explained while assuming that developing operations are performed in the order of Bk, C, M and Y color. The order of the developing operations is not limited thereto.

The image forming method of the present invention will be explained in detail. An image of an original is read with a color scanner (not shown). The photoreceptor 90, which has been entirely charged, is exposed to imagewise laser light based on the black image data of the read original image. Thus an electrostatic latent image (hereinafter referred to as a Bk latent image) is formed on the photoreceptor. The developing sleeve 141 is rotated so as to be able to develop from the tip edge of the Bk latent image with a Bk developer (hereinafter referred to as a Bk toner). This Bk developing operation is continued until the end of the Bk latent image passes though the Bk developing area. After the end of the Bk latent image passes though the Bk developing area, the Bk developing device 140 is allowed to achieve a non-developing state so as not to develop other color (C, M or Y) latent images.

The developing operation may be performed by a posi-posi developing method or a nega-posi developing method (i.e, a reverse developing method).

Then the Bk toner image formed on the photoreceptor 90 is transferred onto the intermediate transfer belt 190 which rotates at the same speed as that of the photoreceptor 90. The transferring of toner images from the photoreceptor 90 to the intermediate transfer belt 190 is hereinafter referred to as a first image transfer. The first image transfer is performed while the photoreceptor 90 contacts the intermediate transfer belt 190 and a transfer bias voltage is applied to the intermediate transfer belt 190 and the photoreceptor 90. This first image transfer is repeated with respect to the other color (C, M and Y) toner images, which correspond to each of the color image data obtained by color-separating the original image, to form a full color toner image on the intermediate transfer belt 190. The full color image is then transferred onto a receiving paper (hereinafter referred to as a second image transfer). The intermediate transfer belt 190 will be explained later in detail.

Then the photoreceptor 90, which has finished to transfer the Bk toner images and is cleaned by the cleaning unit 1000, is again entirely charged and exposed to imagewise laser light based on the cyan image data of the original image. Thus a C latent image is formed on the photoreceptor. The developing sleeve 151 is rotated so as to be able to develop from the tip edge of the C latent image with a C developer (hereinafter referred to as a C toner). This C developing operation is continued until the end of the C latent image passes though the C developing area. After the end of the C latent image passes though the C developing area, the C developing device 150 is allowed to achieve a non-developing state so as not to develop other color (M or Y) latent images.

Then the first toner image transfer process is repeated with respect to the M toner image and Y toner image in this order to form a full color toner image on the intermediate transfer belt 190.

The intermediate transfer belt 190 is wound around bias rollers 20, a drive roller 210 and a driven roller 350. The rotation of the drive roller 200 is controlled by a drive motor (not shown). A belt cleaning unit 220 has a brush roller 221 in which about a half portion of a brush is exposed, a rubber blade 222 etc. The belt cleaning unit 220 is allowed to be attached to or detached from the intermediate transfer belt 190 by a attaching/detaching mechanism (not shown). The belt cleaning unit 220 is allowed to be detached from the intermediate transfer belt 190 from the start of an image forming operation to the end of the first Y image transfer. When all the first image transfer processes are finished, the cleaning unit 220 is allowed to be attached to the intermediate transfer belt 190 at a predetermined time to clean the surface of the intermediate transfer belt 190 from which the full color toner image has been transferred onto a receiving paper 240.

An image transfer unit 230 has a transfer bias roller 231 (i.e., an electric field forming device for the secondary image transfer), a roller cleaning blade 232, a attaching/detaching device 233 which can attach/detach the transfer unit to/from the intermediate transfer belt 190, etc. The bias roller 231 is normally detached from the intermediate transfer belt 190. When the full color toner image formed on the intermediate transfer belt 190 is transferred onto the receiving paper 240, the bias roller 231 is timely attached to the intermediate transfer belt 190 by the attaching/detaching device 233 while a predetermined bias voltage is applied to the bias roller 231. Thus, the full color toner image is transferred onto the receiving paper 240. The receiving paper 240 on which the full color toner images are formed is then fed to a belt fixing device (not shown) by a paper feeding unit 270 to fix the full color toner image on the receiving paper 240. The fixing operation is performed according to the method mentioned above.

After each of the first image transfer operations are finished, the surface of the photoreceptor 90 is cleaned with the cleaning unit 1000 and then uniformly discharged with the discharging lamp 110.

As mentioned above, a full color image is formed on a receiving material by first transferring color toner images formed on the photoreceptor 90 to the intermediate transfer belt 190 one by one and then secondarily transferring the color toner images from the intermediate transfer belt 190 to the receiving paper 240 at once.

In the present embodiment, only one photoreceptor 90 is used. However, a plurality of photoreceptors maybe used. For example, each of the photoreceptors may bear a Bk image, a C image, an M image and a Y image.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following four color toners were prepared.

Black toner

The following components were agitated with a flusher.

| | |
|---|---|
| Water | 1200 |
| Aqueous cake including phthalocyanine green (solid content of 30%) | 200 |
| Carbon black (Tradenamed as MA60 and manufactured by Mitsubishi Chemical Corp., a Japanese company) | 540 |
| Then the following components were kneaded at 150 ° C. for 30 minutes. | |
| Mixture prepared above | 1940 |
| polyester resin (the polyester resin has an acid value of 5; a number average molecular weight (Mn) of 45,000; a Mw/Mn ratio of 4.0; and a glass transition temperature (Tg) of 60° C.) | 1200 |

Further, 1000 parts of xylene were added to the kneaded mixture, and the mixture was further kneaded for one hour. After the water and xylene were removed from the mixture, the mixture was subjected to a roll cooling treatment and then pulverized with a pulverizer. Thus a black pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Black pigment master batch prepared above | 8 |
| Zinc salicylate derivative (Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.4 $\mu$m. Then the mixture was pulverized and classified to prepare a black mother toner having a volume average particle diameter of 7 $\mu$m.

A hydrophobic silica (Tradenamed as HDK2000H and manufactured by Clariant) was added to the black mother toner in an amount of 0.6% by weight, and the mixture was mixed with a mixer. Thus, a black toner was prepared.

Yellow toner

The following components were agitated with a flusher.

| | |
|---|---|
| Water | 600 |
| Aqueous cake including Pigment Yellow 17 (solid content of 50 %) | 1200 |
| Then the following components were kneaded at 150° C. for 30 minutes. | |
| Mixture prepared above | 1800 |
| polyester resin (the polyester resin has an acid value of 5; a number average molecular weight (Mn) of 45,000; a Mw/Mn ratio of 4.0; and a glass transition temperature (Tg) of 60° C.) | 1200 |

Further, 1000 parts of xylene were added to the kneaded mixture, and the mixture was further kneaded for one hour. After the water and xylene were removed from the mixture, the mixture was subjected to a roll cooling treatment and then pulverized with a pulverizer. The pulverized mixture was then subjected to two cycles of a kneading treatment using a three-roll mill. Thus a yellow pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Yellow pigment master batch prepared above | 8 |
| Zinc salicylate derivative | 4 |

(Tradenamed as Bontron E84 and manufactured by Orient Chemical Industries Co., Ltd.)

The kneaded mixture was subjected to a roll cooling treatment. The average major particle diameter of the pigment (i.e., the colorant) dispersed in the kneaded mixture was 0.4 $\mu$m. Then the mixture was pulverized and classified to prepare a yellow mother toner having a volume average particle diameter of 7 $\mu$m.

A hydrophobic silica (Tradenamed as HDK2000H and manufactured by Clariant) was added to the yellow mother toner in an amount of 0.6% by weight, and the mixture was mixed with a mixer. Thus, a yellow toner was prepared.

Magenta toner

The following components were agitated with a flusher.

| | |
|---|---|
| Water | 600 |
| Aqueous cake including Pigment Red 57 (solid content of 50%) | 1200 |
| Then the following components were kneaded at 150° C. for 30 minutes. | |
| Mixture prepared above | 1800 |
| polyester resin | 1200 |

(the polyester resin has an acid value of 5; a number average molecular weight (Mn) of 45,000; a Mw/Mn ratio of 4.0; and a glass transition temperature (Tg) of 60° C.)

Further, 1000 parts of xylene were added to the kneaded mixture, and the mixture was further kneaded for one hour. After the water and xylene were removed from the mixture, the mixture was subjected to a roll cooling treatment and then pulverized with a pulverizer. The pulverized mixture was then subjected to two cycles of a kneading treatment using a three-roll mill. Thus a magenta pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Magenta pigment master batch prepared above | 8 |
| Zinc salicylate derivative (Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.4 μm. Then the mixture was pulverized and classified to prepare a magenta mother toner having a volume average particle diameter of 7 μm.

A hydrophobic silica (Tradenamed as HDK2000H and manufactured by Clariant) was added to the magenta mother toner in an amount of 0.6% by weight, and the mixture was mixed with a mixer. Thus, a magenta toner was prepared.

Cyan toner

The following components were agitated with a flusher.

| | |
|---|---|
| Water | 600 |
| Aqueous cake including Pigment Blue 15:3 (solid content of 50%) | 1200 |
| Then the following components were kneaded at 150° C. for 30 minutes. | |
| Mixture prepared above | 1800 |
| polyester resin (the polyester resin has an acid value of 5; a number average molecular weight (Mn) of 45,000; a Mw/Mn ratio of 4.0; and a glass transition temperature (Tg) of 60° C.) | 1200 |

Further, 1000 parts of xylene were added to the kneaded mixture, and the mixture was further kneaded for one hour. After the water and xylene were removed from the mixture, the mixture was subjected to a roll cooling treatment and then pulverized with a pulverizer. The pulverized mixture was then subjected to two cycles of a kneading treatment using a three-roll mill. Thus a cyan pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Cyan pigment master batch prepared above | 5 |
| Zinc salicylate derivative (Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.4 μm. Then the mixture was pulverized and classified to prepare a cyan mother toner having a volume average particle diameter of 7 μm.

A hydrophobic silica (Tradenamed as HDK2000H and manufactured by Clariant) was added to the cyan mother toner in an amount of 0.6% by weight, and the mixture was mixed with a mixer. Thus, a cyan toner was prepared.

The thus prepared four color toners were set in a color copier, which is a modified copier of IPSIO COLOR 5000 manufactured by Ricoh Co., Ltd. and whose fixing device is shown in FIG. 1. When 10,000 color images were produced, the belt had no hurts and the produced images had no streak images due to hurts of the belt. In addition, when one hundred color images were continuously produced, the resultant color images were sharp color images without undesired images such as offset images and poorly-fixed images.

Example 2

Black toner

The following components were agitated with a Henshel mixer.

| | |
|---|---|
| Water/acetone mixture solvent | 75 |
| Polyester resin (the polyester resin has an acid value of 5; a number average molecular weight (Mn) of 45,000; a Mw/Mn ratio of 4.0; and a glass transition temperature (Tg) of 60° C.) | 500 |
| Carbon black (Tradenamed as MA60 and manufactured by Mitsubishi Chemical Corp., a Japanese company) | 540 |

The mixture was kneaded upon application of heat using a two-roll mill having a cooling device in the rolls while the temperature of the kneaded mixture was controlled so as to be a temperature of from 90° C. to 95° C.

After 10-minute kneading followed by cooling, and the mixture was pulverized with a pulverizer. Thus a black pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Black pigment master batch prepared above | 8 |
| Zinc salicylate derivative (Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.4 μm. Then the mixture was pulverized and classified to prepare a black mother toner having a volume average particle diameter of 7 μm.

A hydrophobic silica (Tradenamed as HDK2000H and manufactured by Clariant) was added to the black mother toner in an amount of 0.5% by weight, and the mixture was mixed with a mixer. Thus, a black toner was prepared.

Yellow toner

The following components were agitated with a Henshel mixer.

| | |
|---|---|
| Water/acetone mixture solvent | 75 |
| Polyester resin<br>(the polyester resin has an acid value ot 5; a number average molecular weight (Mn) of 45,000; a Mw/Mn ratio of 4.0; and a glass transition temperature (Tg) of 60° C.) | 500 |
| Yellow pigment<br>(Tradenamed as PY-HG and manufactured by Hoechst AG) | 500 |

The mixture was kneaded upon application of heat using a two-roll mill having a cooling device in the rolls while the temperature of the kneaded mixture was controlled so as to be a temperature of from 90° C. to 95° C.

After 10-minute kneading followed by cooling, and the mixture was pulverized with a pulverizer. Thus a yellow pigment master batch was prepared.

The following components were mixed and then kneaded with a two-roll mill while the mixture was melted.

Polyester resin 100

(the polyester resin has an acid value of 5; a number average molecular weight (Mn) of 45,000; a Mw/Mn ratio of 4.0; and a glass transition temperature (Tg) of 60° C.)

| | |
|---|---|
| Yellow pigment master batch prepared above. | 8 |
| Zinc salicylate derivative<br>(Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.3 μm. Then the mixture was pulverized and classified to prepare a yellow mother toner having a volume average particle diameter of 7 μm.

A hydrophobic silica (Tradenamed as HDK2000H and manufactured by Clariant) was added to the yellow mother toner in an amount of 0.5% by weight, and the mixture was mixed with a mixer. Thus, a yellow toner was prepared.

Magenta toner

The following components were agitated with a Henshel mixer.

| | |
|---|---|
| Water/acetone mixture solvent | 75 |
| Polyester resin<br>(the polyester resin has an acid value of 5; a number average molecular weight (Mn) of 45,000; a Mw/Mn ratio of 4.0; and a glass transition temperature (Tg) of 60° C.) | 600 |
| Red pigment<br>(Tradenamed as KET RED 309 and manufactured by Dainippon Ink and Chemicals, Inc., a Japanese company) | 400 |

The mixture was kneaded upon application of heat using a two-roll mill having a cooling device in the rolls while the temperature of the kneaded mixture was controlled so as to be a temperature of from 90° C. to 95° C.

After 10-minute kneading followed by cooling, and the mixture was pulverized with a pulverizer. Thus a magenta pigment master batch was prepared.

The following components were mixed and then kneaded with a two-roll mill while the mixture was melted.

| | |
|---|---|
| Polyester resin<br>(the polyester resin has an acid value of 5; a number average molecular weight (Mn) of 45,000; a Mw/Mn ratio of 4.0; and a glass transition temperature (Tg) of 60° C.) | 100 |
| Magenta pigment master batch prepared above | 10 |
| Zinc salicylate derivative<br>(Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.2 μm. Then the mixture was pulverized and classified to prepare a magenta mother toner having a volume average particle diameter of 7 μm.

A hydrophobic silica (Tradenamed as HDK2000H and manufactured by Clariant) was added to the magenta mother toner in an amount of 0.5% by weight, and the mixture was mixed with a mixer. Thus, a magenta toner was prepared.

Cyan toner

The following components were agitated with a Henshel mixer.

| | |
|---|---|
| Water/acetone mixture solvent | 75 |
| Polyester resin<br>(the polyester resin has an acid value of 5; a number average molecular weight (Mn) of 45,000; a Mw/Mn ratio of 4.0; and a glass transition temperature (Tg) of 60° C.) | 600 |
| Blue pigment<br>(Tradenamed as LINOL BLUE FG-7351 and manufactured by Toyo Ink Manufacturing Co., Ltd., a Japanese company) | 400 |

The mixture was kneaded upon application of heat using a two-roll mill having a cooling device in the rolls while the temperature of the kneaded mixture was controlled so as to be a temperature of from 90° C. to 95° C.

After 10-minute kneading followed by cooling, and the mixture was pulverized with a pulverizer. Thus a cyan pigment master batch was prepared.

The following components were mixed and then kneaded with a two-roll mill while the mixture was melted.

| | |
|---|---|
| Polyester resin<br>(the polyester resin has an acid value of 5; a number average molecular weight (Mn) of 45,000; a Mw/Mn ratio of 4.0; and a glass transition temperature (Tg) of 60° C.) | 100 |
| Cyan pigment master batch prepared above | 8 |
| Zinc salicylate derivative<br>(Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.3 μm. Then the mixture was pulverized and classified to prepare a cyan mother toner having a volume average particle diameter of 7 μm.

A hydrophobic silica (Tradenamed as HDK2000H and manufactured by Clariant) was added to the cyan mother toner in an amount of 0.5% by weight, and the mixture was mixed with a mixer. Thus, a cyan toner was prepared.

The thus prepared four color toners were set in a color copier, which is a modified copier of IPSIO COLOR 5000 manufactured by Ricoh Co., Ltd. and whose fixing device was modified to that as shown in FIG. 1. When 10,000 color images were produced, the belt had no hurts and the produced images had no streak images due to hurts of the belt. In addition, when one hundred color images were continuously produced, the resultant color images were sharp color images without undesired images such as offset images and poorly-fixed images.

Example 3

Preparation of carrier A

The following components were mixed for 30 minutes using a homomixer to prepare a carrier coating liquid.

| | |
|---|---|
| Silicone resin solution (Tradenamed as KR50 and manufactured by Shin-Etsu Chemical Co., Ltd., a Japanese company) | 99 |
| γ-(2-aminoethyl) aminopropyl trimethoxysilane | 1 |
| Carbon black (Tradenamed as BP2000 and manufactured by Cabot Corp.) | 2 |
| Toluene | 100 |

One thousand (1,000) parts of a spherical ferrite having an average particle diameter of 50 μm were coated with the carrier coating liquid using a fluidized bed type coating apparatus. Thus a resin layer was formed on the surface of the carrier material. Thus a carrier A was prepared.

Preparation of black, yellow. magenta and cyan toner

The procedures for preparation of the black, yellow, magenta and cyan toner in Example 1 were repeated except that the addition amount of the salicylic acid derivative was changed from 4 parts to 1.5 parts. Thus, a black, yellow, magenta and cyan toner were prepared.

Preparation of two component developer

The following components were mixed to prepare a black, yellow, magenta and cyan developer.

| | |
|---|---|
| Toner | 5 |
| Carrier | 95 |

The thus prepared four color developers were set in a color copier, which is a modified copier of IMAGIO COLOR 4000 manufactured by Ricoh Co., Ltd. and whose fixing device was modified to that as shown in FIG. 1. When 10,000 color images were produced, the belt had no hurts and the produced images had no streak images due to hurts of the belt. In addition, when one hundred color images were continuously produced, the resultant color images were sharp color images without undesired images such as offset images and poorly-fixed images.

Comparative Example 1

Black toner

The following components were agitated with a Henshel mixer.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 700 |

-continued

| | |
|---|---|
| Carbon black (Tradenamed as MA60 and manufactured by Mitsubishi Chemical Corp., a Japanese company) | 300 |

The mixture was subjected to three cycles of a kneading treatment using a three-roll mill to knead the mixture upon application of heat.

After being cooled, the mixture was pulverized with a pulverizer. Thus a black pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Black pigment master batch prepared above | 14 |
| Zinc salicyiate derivative (Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.6 μm. Then the mixture was pulverized and classified to prepare a black mother toner having a volume average particle diameter of 7 μm.

A hydrophobic silica (Tradenamed as HDK2000H and manufactured by Clariant) was added to the black mother toner in an amount of 0.5% by weight, and the mixture was mixed with a mixer. Thus, a comparative black toner was prepared.

Yellow toner

The following components were agitated with a Henshel mixer.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 700 |
| Yellow pigment (Tradenamed as LIONOL YELLOW FG-1 and manufactured by Toyo Ink Manufacturing Co., ltd., a Japanese company) | 300 |

The mixture was subjected to three cycles of a kneading treatment using a three-roll mill to knead the mixture upon application of heat.

After being cooled, the mixture was pulverized with a pulverizer. Thus a Yellow pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |

-continued

| | |
|---|---|
| Yellow pigment master batch prepared above | 14 |
| Zinc salicylate derivative (Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.6 μm. Then the mixture was pulverized and classified to prepare a yellow mother toner having a volume average particle diameter of 7 μm.

A hydrophobic silica (Tradenamed as HDK2000H and manufactured by Clariant) was added to the yellow mother toner in an amount of 0.5% by weight, and the mixture was mixed with a mixer. Thus, a comparative yellow toner was prepared.

Preparation of magenta toner

The following components were agitated with a Henshel mixer.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Red pigment (Tradenamed as PPE02 and manufactured by Hoechst AG) | 300 |

The mixture was subjected to three cycles of a kneading treatment using a three-roll mill to knead the mixture upon application of heat.

After being cooled, the mixture was pulverized with a pulverizer. Thus a magenta pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Black pigment master batch prepared above | 14 |
| Zinc salicylate derivative (Tradenamed as Bontron E84 and manufactured by Orient Chemical Industries Co., Ltd.) | 2 |

The kneaded mixture was subjected to a roll cooling treatment. The average major particle diameter of the pigment (i.e., the colorant) dispersed in the kneaded mixture was 0.8 μm. Then the mixture was pulverized and classified to prepare a magenta mother toner having a volume average particle diameter of 7 μm.

A hydrophobic silica (Tradenamed as HDK2000H and manufactured by Clariant) was added to the magenta mother toner in an amount of 0.5% by weight, and the mixture was mixed with a mixer. Thus, a comparative magenta toner was prepared.

Preparation of cyan toner

The following components were agitated with a Henshel mixer.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 700 |
| Blue pigment (Tradenamed as LIONOL BLUE FG-7351 and manufactured by Toyo Ink Manufacturing Co., Ltd., a Japanese company) | 300 |

The mixture was subjected to three cycles of a kneading treatment using a three-roll mill to knead the mixture upon application of heat.

After being cooled, the mixture was pulverized with a pulverizer. Thus a cyan pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Cyan pigment master batch prepared above | 10 |
| Zinc salicylate derivative (Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.7 μm. Then the mixture was pulverized and classified to prepare a cyan mother toner having a volume average particle diameter of 7 μm.

A hydrophobic silica (Tradenamed as HDK2000H and manufactured by Clariant) was added to the cyan mother toner in an amount of 0.5% by weight, and the mixture was mixed with a mixer. Thus, a comparative cyan toner was prepared.

The thus prepared four color toners were set in a color copier, which is a modified copier of IPSIO COLOR 5000 manufactured by Ricoh Co., Ltd. and whose fixing device was modified to that as shown in FIG. 1. An image forming test was performed. When three hundred color images were produced, the belt had hurts. When three thousand color images were produced, the belt had many hurts, and the produced images had many streak images due to hurts of the belt. When one hundred color images were continuously produced, the resultant color images were sharp color images without image defects such as offset images and poorly-fixed images.

Comparative Example 2

Preparation of black toner

The following components were agitated with a Henshel mixer.

| | |
|---|---|
| Water/acetone mixture solvent | 200 |
| Polyester resin (the polyester resin has an acidvalue of 5; a number average molecular weight (Mn) of 45,000; a Mw/Mn ratio of 4.0; and a glass transition temperature (Tg) of 60° C.) | 500 |
| Carbon black (Tradenamed as MA60 and manufactured by Mitsubishi Chemical Corp., a Japanese company) | 500 |

The mixture was kneaded upon application of heat using a two-roll mill having a cooling device in the rolls while the temperature of the kneaded mixture was controlled so as to be a temperature of from 90° C. to 95° C.

After 10-minute kneading followed by cooling, and the mixture was pulverized with a pulverizer. Thus a black pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Black pigment master batch prepared above | 8 |
| Zinc salicylate derivative (Tradenamed as Bontron E84 and manufactured by Orient Chemical Industries Co., Ltd.) | 4 |
| Polyester resin (the polyester resin has an acid value of 5; a number average molecular weight (Mn) of 45,000; a Mw/Mn ratio of 4.0; and a glass transition temperature (Tg) of 60° C.) | 100 |
| Black pigment master batch prepared above | 8 |
| Zinc salicylate derivative (Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.6 μm. Then the mixture was pulverized and classified to prepare a black mother toner having a volume average particle diameter of 7 μm.

A hydrophobic silica (Tradenamed as HDK2000H and manufactured by Clariant) was added to the black mother toner in an amount of 0.5% by weight, and the mixture was mixed with a mixer. Thus, a comparative black toner was prepared.

Yellow toner

The following components were agitated with a Henshel mixer.

| | |
|---|---|
| Water/acetone mixture solvent | 100 |
| Polyester resin (the polyester resin has an acid value of 5; a number average molecular weight (Mn) of 45,000; a Mw/Mn ratio of 4.0; and a glass transition temperature (Tg) of 60° C.) | 500 |
| Yellow pigment (Tradenamed as PY-HG and manufactured by Hoechst AG) | 500 |

The mixture was kneaded upon application of heat using a two-roll mill having a cooling device in the rolls while the temperature of the kneaded mixture was controlled so as to be a temperature of from 90° C. to 95° C.

After 10-minute kneading followed by cooling, and the mixture was pulverized with a pulverizer. Thus a yellow pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |

-continued

| | |
|---|---|
| Yellow pigment master batch prepared above | 8 |
| Zinc salicylate derivative (Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.8 μm. Then the mixture was pulverized and classified to prepare a yellow mother toner having a volume average particle diameter of 7 μm.

A hydrophobic silica (Tradenamed as HDK2000H and manufactured by Clariant) was added to the yellow mother toner in an amount of 0.5% by weight, and the mixture was mixed with a mixer. Thus, a comparative yellow toner was prepared.

Magenta toner

The following components were agitated with a Henshel mixer.

| | |
|---|---|
| Water/acetone mixture solvent | 100 |
| Polyester resin (the polyester resin has an acid value of 5; a number average molecular weight (Mn) of 45,000; a Mw/Mn ratio of 4.0; and a glass transition temperature (Tg) of 60° C.) | 600 |
| Red pigment (Tradenamed as KET RED 309 and manufactured by Dainippon Ink and Chemicals, Inc.) | 400 |

The mixture was kneaded upon application of heat using a two-roll mill having a cooling device in the rolls while the temperature of the kneaded mixture was controlled so as to be a temperature of from 90° C. to 95° C.

After 10-minute kneading followed by cooling, and the mixture was pulverized with a pulverizer. Thus a magenta pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Magenta pigment master batch prepared above | 10 |
| Zinc salicylate derivative (Tradenamed as Bontron E84 and manufactured by Orient Chemical Industries Co., Ltd.) | 4 |

The kneaded mixture was subjected to a roll cooling treatment. The average major particle diameter of the pigment (i.e., the colorant) dispersed in the kneaded mixture was 0.5 μm. Then the mixture was pulverized and classified to prepare a magenta mother toner having a volume average particle diameter of 7 μm.

A hydrophobic silica (Tradenamed as HDK2000H and manufactured by Clariant) was added to the magenta mother toner in an amount of 0.5% by weight, and the mixture was mixed with a mixer. Thus, a comparative magenta toner was prepared.

Cyan toner

The following components were agitated with a Henshel mixer.

| | |
|---|---|
| Water/acetone mixture solvent | 100 |
| Polyester resin (the polyester resin has an acid value of 5; a number average molecular weight (Mn) of 45,000; a Mw/Mn ratio of 4.0; and a glass transition temperature (Tg) of 60° C.) | 500 |
| Blue pigment (Tradenamed as LINOL BLUE FG-7351 and manufactured by Toyo Ink Manufacturing Co., Ltd., a Japanese company) | 500 |

The mixture was kneaded upon application of heat using a two-roll mill having a cooling device in the rolls while the temperature of the kneaded mixture was controlled so as to be a temperature of from 90° C. to 95° C.

After 10-minute kneading followed by cooling, and the mixture was pulverized with a pulverizer. Thus a cyan pigment master batch was prepared.

The following components were mixed and then kneaded with a two-roll mill while the mixture was melted.

| | |
|---|---|
| Polyester resin (the polyester resin has an acid value of 5; a number average molecular weight (Mn) of 45,000; a Mw/Mn ratio of 4.0; and a glass transition temperature (Tg) of 60° C.) | 100 |
| Cyan pigment master batch prepared above | 5 |
| Zinc salicylate derivative (Tradenamed as Bontron E84 and manufactured by Orient Chemical Industries Co.. Ltd.) | 4 |

The kneaded mixture was subjected to a roll cooling treatment. The average major particle diameter of the pigment (i.e., the colorant) dispersed in the kneaded mixture was 0.5 μm. Then the mixture was pulverized and classified to prepare a cyan mother toner having a volume average particle diameter of 7 μm.

A hydrophobic silica (Tradenamed as HDK2000H and manufactured by Clariant) was added to the cyan mother toner in an amount of 0.5% by weight, and the mixture was mixed with a mixer. Thus, a comparative cyan toner was prepared.

The thus prepared four color toners were set in a color copier, which is a modified copier of IPSIO COLOR 5000 manufactured by Ricoh Co., Ltd. and whose fixing device was modified to that as shown in FIG. 1. An image forming test was performed. When five hundred color images were produced, the belt had hurts. When 4,500 color images were produced, the belt had many hurts, and the produced images had many streak images due to the hurts of the belt. When one hundred color images were continuously produced, the resultant color images were sharp color images without image defects such as offset images and poorly-fixed images.

Comparative Example 3

The procedures for preparation and evaluation of the four color toners in Example 1 were repeated except that the polyester resin was changed to a polyester resin having an acid value of 9.5, a number average molecular weight (Mn) of 5,200, a Mw/Mn ratio of 2.3, and a glass transition temperature of 58° C.

When 10,000 color images were produced, there was no hurt on the belt, and the resultant color images had no streak image due to hurts of the belt. However, when one hundred color images were continuously produced, several offset images were observed in the one hundred copies at an interval of about a dozen of copies.

Comparative Example 4

The procedures for preparation and evaluation of the four color toners were repeated except that the polyester resin was changed to a polyester resin having an acid value of 4.2, a number average molecular weight (Mn) of 10,600, a Mw/Mn ratio of 9.6, and a glass transition temperature of 68° C.

When 10,000 color images were produced, there was no hurt on the belt, and the resultant color images had no streak image due to hurts of the belt. However, when one hundred color images were continuously produced, the resultant color images had poor gloss, and therefore reproduced photographic images were not sharp.

The melt viscosities of the cyan toners prepared in Examples 1 and 2 and Comparative Examples 3 and 4 are shown in FIG. 2. The parameters of the viscosity lines are shown in Table 1.

TABLE 1

| Ex. 1 | Ex. 2 | Comp. Ex. 3 | Comp. Ex. | 4 |
|---|---|---|---|---|
| Slant of line | −0.109 | −0.118 | −0.147 | −0.092 |
| Intercept | 13.68 | 15.19 | 16.88 | 14.04 |
| Ta | 82.7 | 88.7 | 83.1 | 101.7 |
| Tb | 91.9 | 97.1 | 89.9 | 112.6 |
| Tb-Ta | 9.2 | 8.5 | 6.8 | 10.9 |

The value (Tb−Ta) of each of the color toners in Examples 1 to 3 and Comparative Examples 1 to 4 is shown in Table 2.

Table 2

| | Yellow toner | Magenta toner | Cyan toner | Black toner |
|---|---|---|---|---|
| Ex. 1 | 9.4 | 9.4 | 9.2 | 9.3 |
| Ex. 2 | 8.7 | 8.6 | 8.5 | 8.4 |
| Ex. 3 | 9.5 | 9.4 | 9.3 | 9.5 |
| Comp. Ex. 1 | 9.2 | 9.3 | 9.1 | 9.3 |
| Comp. Ex. 2 | 9.3 | 9.4 | 9.2 | 9.4 |
| Comp. Ex. 3 | 6.9 | 6.8 | 6.8 | 6.7 |
| Comp. Ex. 4 | 11.0 | 11.1 | 10.9 | 11.0 |

As can be understood from the above description, the toner of the present invention can produce good images without undesired streak images when used for an image forming apparatus having a fixing device having a belt-shaped fixing element. In particular, when the color toners of the present invention can produce good color images without undesired images such as streak images, offset images and poorly-fixed images.

This document claims priority and contains subject matter related to Japanese Patent Applications No. 11-244689 and 11-302169, filed on Aug. 31, 1999, and Oct. 25, 1999, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a resin and a colorant, wherein said colorant comprises an average major particle diameter not greater than about 0.5 μm, and wherein the following relationships are satisfied:

$$Ta \leqq 100\ (^\circ\ C.),\ \text{and}\ (Tb-Ta) \geqq 7.0\ (^\circ\ C.)$$

wherein Ta represents a temperature at which the toner has a melt viscosity of 50,000 Pa·sec, and Tb represents a temperature at which the toner has a melt viscosity of 5,000 Pa·sec.

2. The toner according to claim 1, wherein the toner is selected from the group consisting of a yellow toner, a magenta toner, a cyan toner and mixture thereof.

3. The toner according to claim 1, wherein the toner is manufactured by a master batch process comprising kneading at least the colorant and a part of the resin together at a temperature ranging from a glass transition temperature of the resin to a temperature greater than said glass transition temperature by 40° C.

4. The toner according to claim 1, wherein the toner is manufactured by a master batch process comprising kneading at least the colorant and a part of the resin together at a temperature ranging from a glass transition temperature of the resin to a temperature greater than said glass transition temperature by 20° C.

5. A toner container comprising at least an opening and the toner according to claim 1.

6. A two-component developer comprising a carrier and the toner according to claim 1.

7. The two-component developer according to claim 6, wherein, prior to mixing with said toner, said carrier is previously subjected to a screening treatment in which carrier particles having a relatively low magnetic force are removed from said carrier.

8. A developer container comprising at least an opening and the developer according to claim 6.

9. An image forming apparatus comprising:

an image bearing member having an electrostatic latent image thereon;

the developer container comprising the toner according to claim 1;

a developing device which develops the latent image with a developer to form a toner image;

a transfer device which transfers the toner image onto a receiving material; and a fixing device, comprising:

at least one selected from the group consisting of a belt and an endless belt; and a heating element, wherein the toner image is fixed while being contacted with said belt, said endless belt, or both.

10. The image forming apparatus according to claim 9, wherein the developer container further comprises a carrier.

11. The image forming apparatus according to claim 9, wherein said developer is present in said container and is a two-component developer comprising a carrier.

12. A full color image forming apparatus comprising:

an image bearing member having an electrostatic latent image thereon;

a yellow, magenta and cyan developer which comprise a yellow, magenta, and cyan toner, respectively;

a yellow developing device which develops the latent image with the developer to form a yellow toner image;

a magenta developing device which develops the latent image with the developer to form a magenta toner image;

a cyan developing device which develops the latent image with the developer to form a cyan toner image;

a transfer device which transfers the yellow, magenta, and cyan toner image onto a receiving material to form a full color image on the receiving material; and a fixing device, comprising:

at least one selected from the group consisting of a belt and an endless belt; and a heating element, wherein the full color toner image is fixed while being contacted with said belt, said endless belt, or both, wherein each of the yellow, magenta and cyan toner comprises a resin and a colorant, said colorant comprising an average major particle diameter not greater than about 0.5 μm, and wherein the following relationships are satisfied:

$$Ta \leqq 100\ (^\circ\ C.),\ \text{and}\ (Tb-Ta) \geqq 7.0\ (^\circ\ C.)$$

wherein Ta represents a temperature at which the toner has a melt viscosity of 50,000 Pa·sec, and Tb represents a temperature at which the toner has a melt viscosity of 5,000 Pa·sec.

13. The full color image forming apparatus according to claim 12, wherein the apparatus further comprises a black developer comprising a black toner, and a black developing device which develops the latent image with the black developer to form a black toner image, and wherein the transfer device transfers the yellow, magenta, cyan and black toner image onto a receiving material to form a full color image on the receiving material, and the full color toner image is fixed while being contact with said belt, said endless belt, or both.

14. An image forming method, comprising:

forming a toner image on a receiving material; and contacting the toner image with at least one selected from the croup consisting of a belt or an endless belt while heating the toner image with a heating element, to fix the toner image, wherein the toner comprises a resin and a colorant, said colorant comprising an average major particle diameter not greater than about 0.5 μm, and wherein the following relationships are satisfied:

$$Ta \leqq 100\ (^\circ\ C.),\ \text{and}\ (Tb-Ta) \geqq 7.0\ (^\circ\ C.)$$

wherein Ta represents a temperature at which the toner has a melt viscosity of 50,000 Pa·sec, and Tb represents a temperature at which the toner has a melt viscosity of 5,000 Pa·sec.

15. A full color image forming method comprising:

forming a full color image, comprising a yellow toner, a magenta toner, and a cyan toner, on a receiving material; and contacting the color toner image with at least one selected from the group consisting of a belt and an endless belt while heating the toner image with a heating element, wherein each of said yellow, magenta and cyan toner comprises a resin and a colorant, said colorant compring an average major particle diameter not greater than about 0.5 μm, wherein the following relationships are satisfied:

$$Ta \leqq 100\ (^\circ\ C.),\ \text{and}\ (Tb-Ta) \geqq 7.0\ (^\circ\ C.)$$

wherein Ta represents a temperature at which the toner has a melt viscosity of 50,000 Pa·sec, and Tb represents a temperature at which the toner has a melt viscosity of 5,000 Pa·sec.

16. The full color image forming method according to claim 15, wherein the full color image further comprises a black toner, wherein the black toner comprises a resin and a colorant, said colorant comprising an average major particle diameter not greater than about 0.5 $\mu$m, wherein the following relationships are satisfied:

$$Ta \leqq 100\ (^\circ\ C.),\ \text{and}\ (Tb-Ta) \geqq 7.0\ (^\circ\ C.)$$

wherein Ta represents a temperature at which the toner has a melt viscosity of 50,000 Pa·sec, and Tb represents a temperature at which the toner has a melt viscosity of 5,000 Pa·sec.

17. The toner according to claim 1, wherein said colorant is dispersed in said toner.

18. The image forming method according to claim 14, wherein said colorant is dispersed in said toner.

19. The image forming method according to claim 15, wherein said colorant is dispersed in said toner.

* * * * *